US008072140B2

(12) United States Patent
Eisemann

(10) Patent No.: US 8,072,140 B2
(45) Date of Patent: Dec. 6, 2011

(54) METAL HALIDE FILL FOR AN ELECTRIC HIGH PRESSURE DISCHARGE LAMP AND ASSOCIATED LAMP

(75) Inventor: Hans Eisemann, Berlin (DE)

(73) Assignee: Osram AG, Munich (DE)

( * ) Notice: Subject to any disclaimer, the term of this patent is extended or adjusted under 35 U.S.C. 154(b) by 168 days.

(21) Appl. No.: 12/226,884

(22) PCT Filed: May 31, 2007

(86) PCT No.: PCT/EP2007/055326

§ 371 (c)(1),
(2), (4) Date: Oct. 31, 2008

(87) PCT Pub. No.: WO2007/141186

PCT Pub. Date: Dec. 13, 2007

(65) Prior Publication Data

US 2009/0108756 A1 Apr. 30, 2009

(30) Foreign Application Priority Data

Jun. 2, 2006 (DE) ..... 10 2006 025 947

(51) Int. Cl.
*H01J 17/20* (2006.01)
*H01J 61/12* (2006.01)

(52) U.S. Cl. ..... 313/572; 313/568; 313/576; 313/637; 313/638; 313/639; 313/640; 313/641

(58) Field of Classification Search ..... 313/637–643, 313/568, 570–572, 576–577
See application file for complete search history.

(56) References Cited

U.S. PATENT DOCUMENTS

| | | | | |
|---|---|---|---|---|
| 3,331,982 | A | 7/1967 | Waymouth et al. | |
| 6,218,781 | B1 * | 4/2001 | Genz et al. | 313/637 |
| 6,284,165 | B1 | 9/2001 | Anderson et al. | |
| 6,400,084 | B1 * | 6/2002 | Eisemann | 313/640 |
| 7,323,820 | B2 * | 1/2008 | Jungst et al. | 313/638 |
| 2003/0001502 | A1 | 1/2003 | Van Erk et al. | |
| 2003/0015949 | A1 * | 1/2003 | Higashi et al. | 313/17 |
| 2003/0067262 | A1 | 4/2003 | Takagaki et al. | |
| 2004/0070322 | A1 | 4/2004 | Ishigami et al. | |
| 2005/0099129 | A1 | 5/2005 | Ishigami et al. | |
| 2005/0134182 | A1 * | 6/2005 | Ishigami et al. | 313/638 |
| 2005/0253528 | A1 * | 11/2005 | Schoeller et al. | 313/637 |
| 2006/0220563 | A1 * | 10/2006 | Genz et al. | 313/641 |
| 2007/0085482 | A1 * | 4/2007 | Lambrechts et al. | 313/637 |
| 2007/0200504 | A1 * | 8/2007 | Brinkhoff et al. | 313/637 |
| 2007/0200505 | A1 * | 8/2007 | Gao et al. | 313/637 |

FOREIGN PATENT DOCUMENTS

| | | | |
|---|---|---|---|
| DE | 190 07 301 | A1 | 2/1999 |
| DE | 199 07 301 | A1 | 2/1999 |
| EP | 1 530 231 | A2 | 5/2005 |
| EP | 1 530 231 | A3 | 5/2005 |
| JP | 2004337627 | A | 12/2004 |
| WO | WO 2005101455 | A2 * | 10/2005 |

* cited by examiner

*Primary Examiner* — Nimeshkumar Patel
*Assistant Examiner* — Jose M Diaz
(74) *Attorney, Agent, or Firm* — Holtz, Holtz, Goodman & Chick, PC

(57) ABSTRACT

A metal-halogenide filling for forming an ionisable filling comprises at least one inert gas, mercury and at least one halogen, the filling including at least the components Rb-halogenide and Mn-halogenide. This filling can in particular be contained in the discharge container of a metal-halogenide lamp.

13 Claims, 7 Drawing Sheets

METAL HALIDE FILL FOR AN ELECTRIC HIGH PRESSURE DISCHARGE LAMP AND ASSOCIATED LAMP

This application is a U.S. National Phase Application under 35 USC 371 of International Application PCT/EP2007/055326, filed May 31, 2007, which is incorporated herein in its entirety by this reference.

TECHNICAL FIELD

The invention is based on a metal halide fill for a high pressure discharge lamp in accordance with the preamble of claim 1. Such fills or lamps are intended in particular for general lighting or else for photooptical purposes.

PRIOR ART

In order to achieve neutral-white and daylight-like light colors with metal halide lamps, various metal halide fills are known. The patent US-A 2003001502 describes a metal halide lamp with a fill which contains Sn, In and the alkaline-earth metals K, Rb and Cs. Owing to its low ionization energy, Cs widens the arc, prevents the arc from being constricted and reduces the running voltage. One disadvantage is the fact that Cs emits a considerable radiation component in the infrared, which radiation component is outside the visible spectral range and therefore reduces the luminous efficiency. The spectrum of such a lamp is illustrated in principle in FIG. 2. A further disadvantage is the relatively high color locus drift which is illustrated in the color locus chart in FIG. 8 in principle.

A metal halide fill with Mn is cited in the patent DE-A 19907301. Since this metal halide fill contains Cs as a further fill constituent, the reduced luminous efficiency is likewise a disadvantage with this fill.

The use of Rb in metal halide lamps is known. For example, a mercury-free metal halide lamp with the fill constituent Rb is represented in the patent US-A 2003067262. However, owing to the lack of mercury, the luminous efficiency is relatively low in this case.

The patent JP-A 2004337627 describes rubidium in a lamp for photodynamic therapy as a special application.

The patent JP-B 7282775 specifies a metal halide lamp with a Dy-Tl system as the fill, which additionally contains neodymium, potassium and rubidium. This fill manages without Cs and is characterized by high color rendering. However, this lamp has a relatively high color locus drift.

DESCRIPTION OF THE INVENTION

The object of the present invention is to provide a metal halide lamp which contains Rb as the fill but does not contain any cesium, a color temperature of at least 4200 K being realized whilst maintaining very good color rendering. In particular, an object of the present invention is to realize a lamp for general lighting with a light color of daylight to neutral-white with $R_a$>90 and in particular $R_9$>70.

This object is achieved by the characterizing features of claim 1.

Particularly advantageous configurations are given in the dependent claims.

In detail, the object is achieved in that the metal halide fill consists of Rb and Mn halide. In order to further improve Ra and R9, they can be combined with further halides. Preferably, halides of the elements Dy, Tl, Ho, Tm, V are used individually or in combination for this purpose.

The combination of Rb and Mn avoids the addition of Cs since Rb, similarly to Cs, has a low ionization energy and therefore widens the arc.

Preferably, if necessary, one of the further elements is added, in each case as a halide. For daylight-like light colors, in particular at a color temperature of more than 5300 K, Dy, Ho, Tm, V, Tl are primarily suitable as an additive, and for neutral-white, in particular at a color temperature of between 4000 and 5200 K, Dy, V, Tl are primarily suitable as an additive.

The relative proportion of the masses of the elements Rb and Mn with respect to one another should preferably be in the region of 0.15 and 210. The proportion of the masses can be, for any other metal, 0.1 to 35 μmol per ml of volume of the discharge vessel.

BRIEF DESCRIPTION OF THE DRAWINGS

The invention will be explained in more detail below with reference to a plurality of exemplary embodiments. In the figures.

PREFERRED EMBODIMENT OF THE INVENTION

Figure 1:
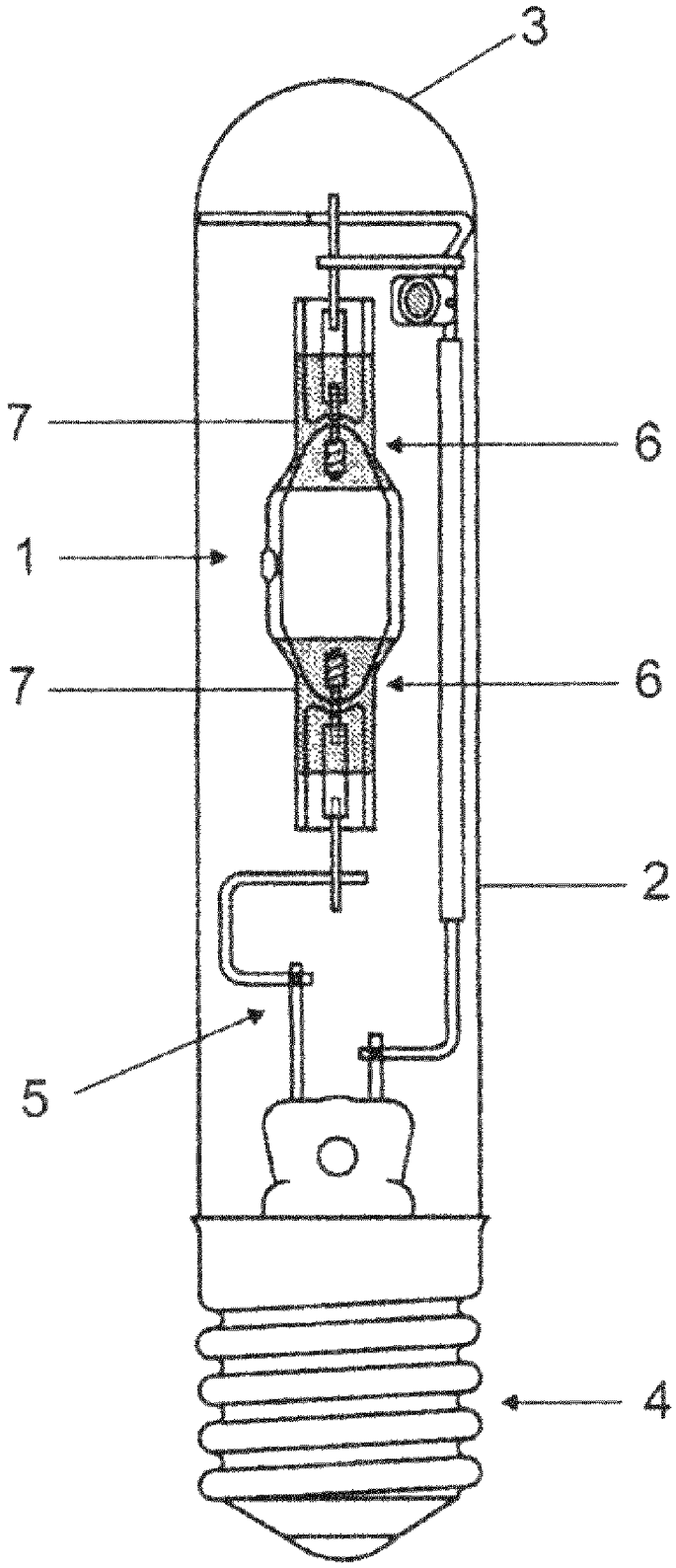
FIG. 1 shows a side view of a metal halide lamp.

An exemplary embodiment of a 400 W metal halide lamp is illustrated schematically in FIG. 1. The lamp in question is a discharge vessel 1, which is surrounded by a cylindrical evacuated outer bulb 2 consisting of hard glass, which outer bulb 2 has a base at one end. One end of the outer bulb 2 has a rounded dome 3, whereas the other end has a screw-type base 4. A holding frame 5 fixes the discharge vessel 1 axially in the interior of the outer bulb 2.

The discharge vessel comprises a burner element, which has a pinch seal at two ends and contains two electrodes 6. The ends of the discharge vessel 1 are provided with a heat-reflecting coating 7. The volume of the discharge vessel 2 is approximately 8 ml. As the basic gas there are 56 mbar of Ar in the discharge vessel. The discharge vessel has been filled with 29 mg of Hg and 14 mg of metal halides. The composition of the metal halide fill is specified in table 1.

TABLE 1

| Proportion of metal halide/wt. % | | | | | | |
|---|---|---|---|---|---|---|
| $DyI_3$ | TlI | $HoI_3$ | $TmI_3$ | $VI_2$ | $MnI_2$ | RbI |
| 27.0 | 13.5 | 8.2 | 8.2 | 2.1 | 23.8 | 17.2 |

The discharge vessel 1 is preferably operated within an outer bulb 2, which is evacuated for particularly good color rendering. In order to increase the life, the outer bulb can contain a gas fill, for example 70 kPa of $N_2$ or 50 kPa of $CO_2$, the color rendering being slightly reduced.

Given an age of 100 h, this lamp has a very similar color temperature of 5050 K, is close on the daylight curve (gap of 0.0012), has a general color rendering index of $R_a$=94, a special color rendering index $R_9$=70 and a luminous efficiency of 84 lm/W.

Figure 2:
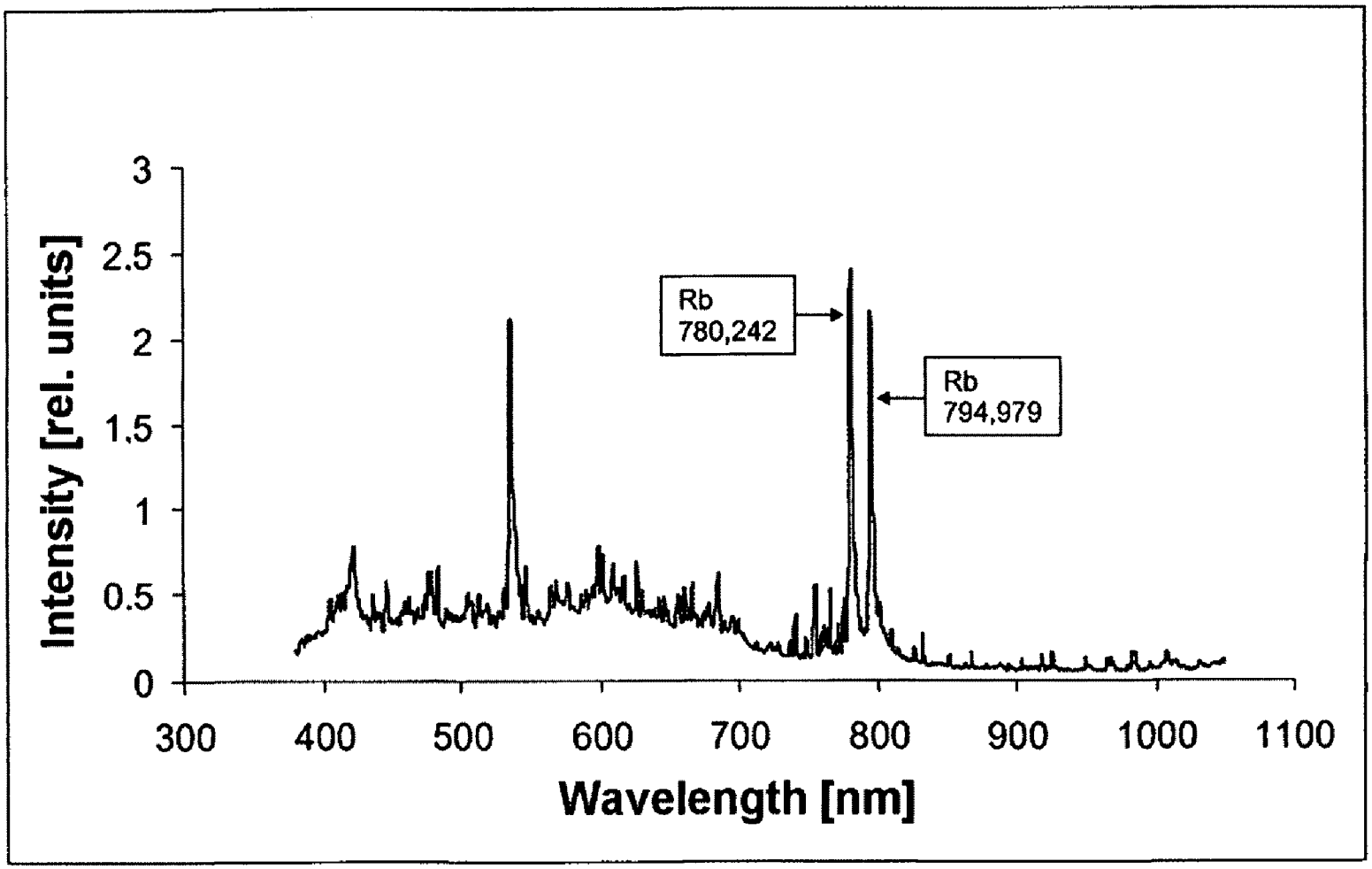
FIGS. 2 to 3 show a spectrum of such a lamp and a comparison lamp.
Figure 3:
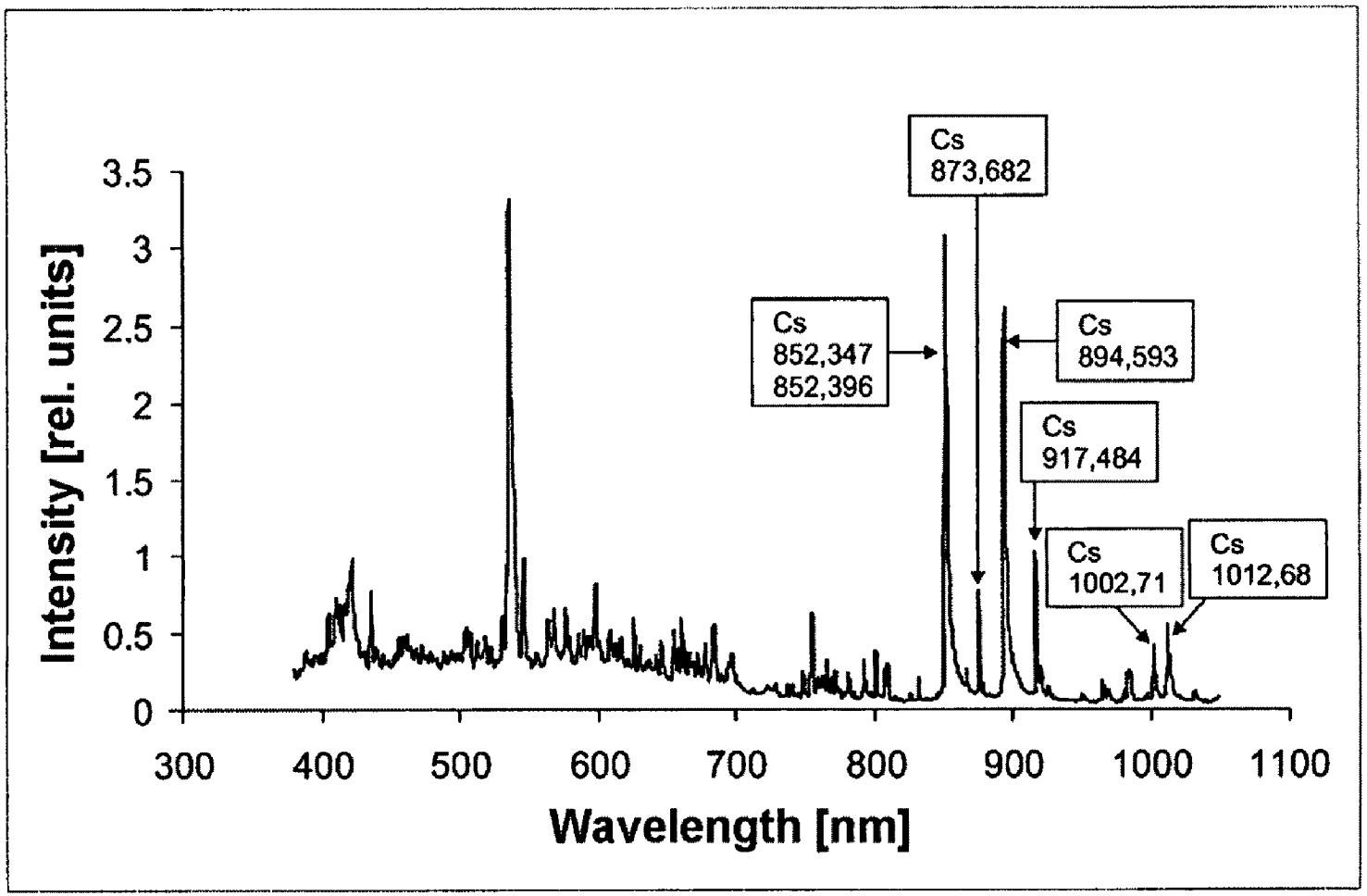
Figure 4:
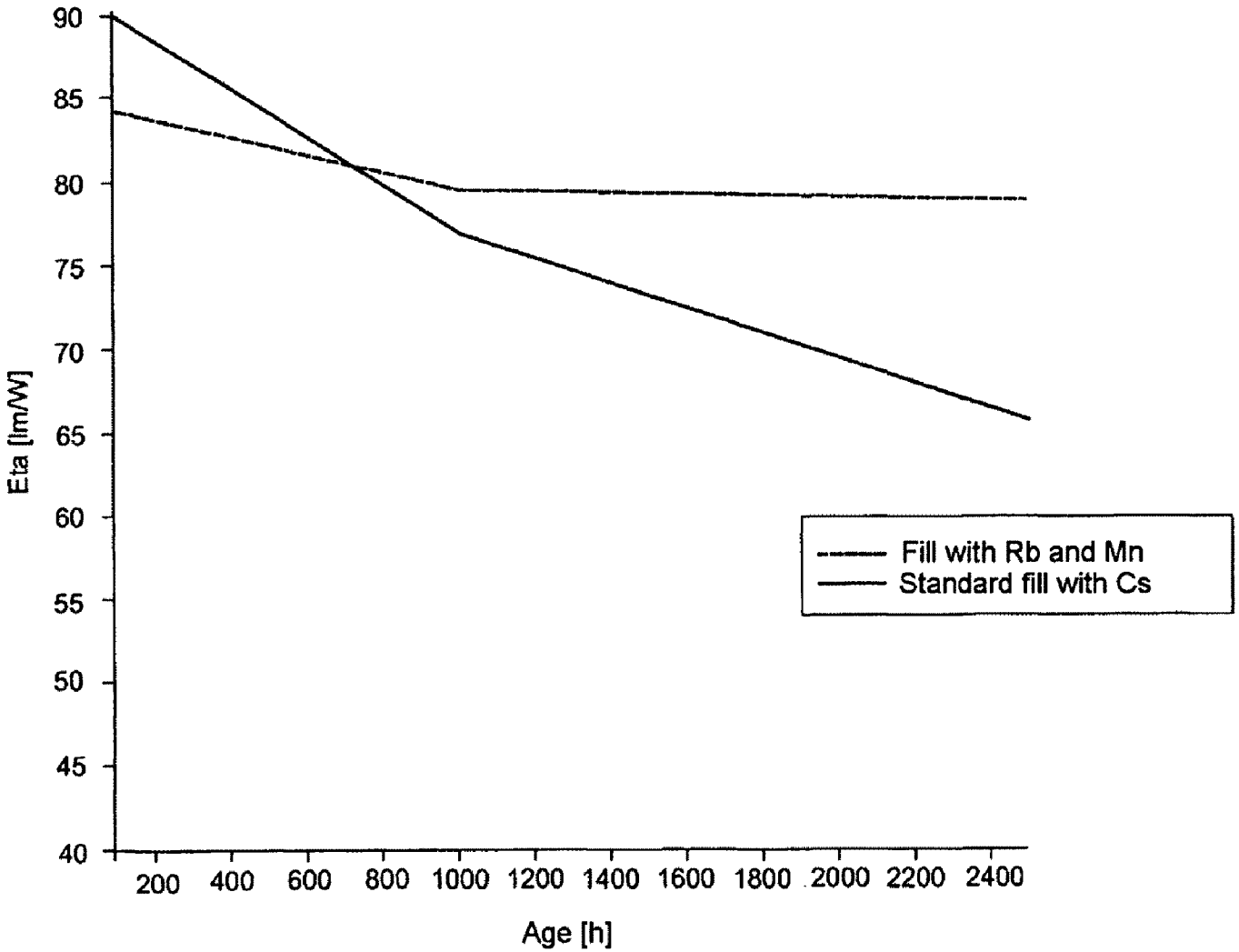
FIGS. 4 to 5 show the luminous efficiency as a function of the life (absolute and relative) of the two lamps from FIGS. 2 and 3.
Figure 5:
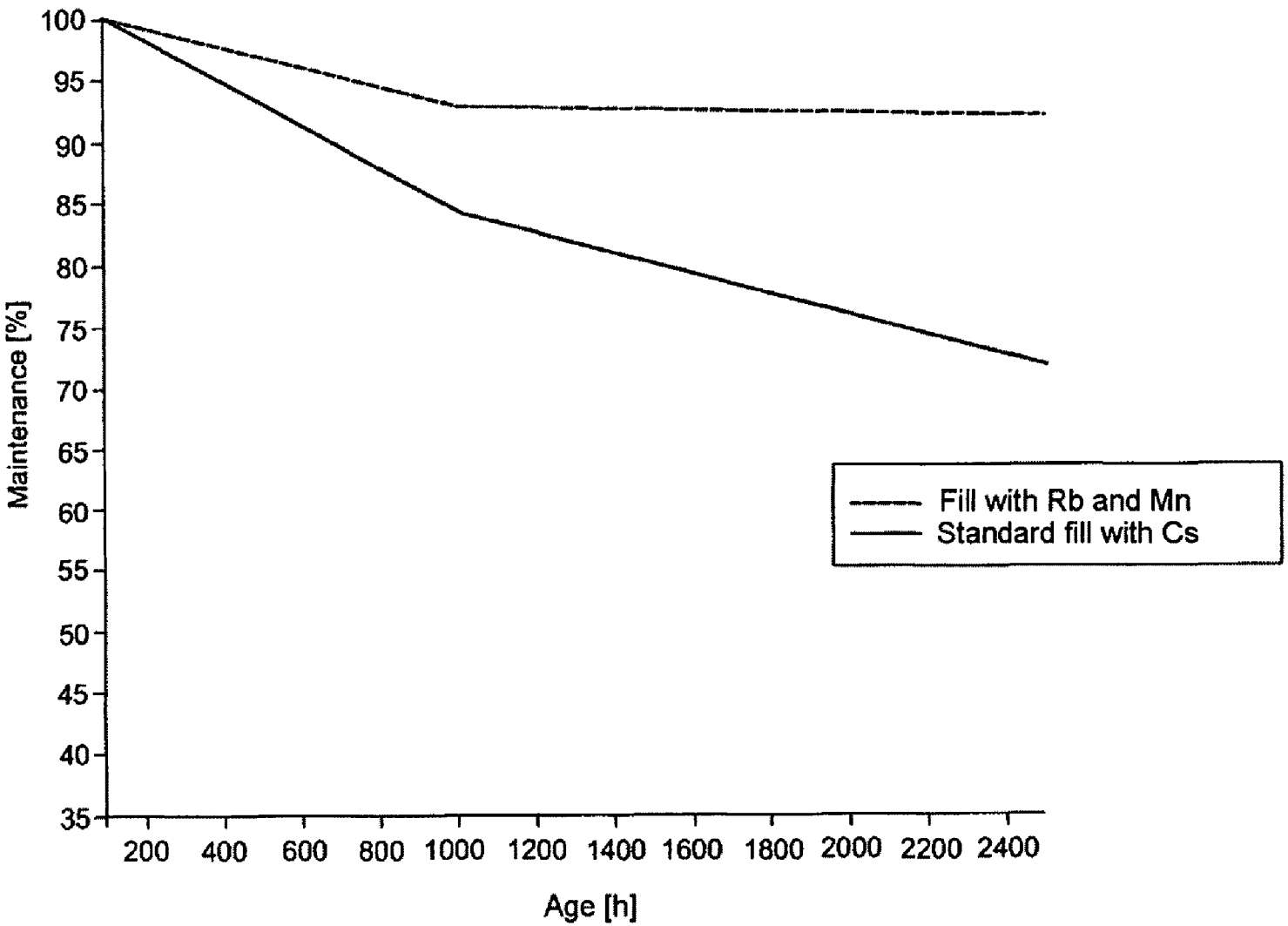

FIG. 2 shows the spectrum of a 100 h-old lamp with marked spectral lines of Rb in accordance with the above-mentioned exemplary embodiment. FIG. 3 shows the spectrum of a comparison lamp with a Cs-containing fill. When comparing FIG. 2 with FIG. 3, it is apparent that the lamp with Rb emits substantially fewer radiation components in the infrared (region above 800 nm) than the lamp with Cs. The fact that the lamp with Rb and Mn has a higher luminous efficiency eta (η) and a higher lumen maintenance in comparison with the standard fill with Cs is illustrated in FIGS. 4 and 5 up to a life of 2500 h. Therein, the luminous efficiency η is represented as a function of the life in hours absolute (FIG. 4) and as a percentage, based on the initial value (FIG. 5).

Figure 6:
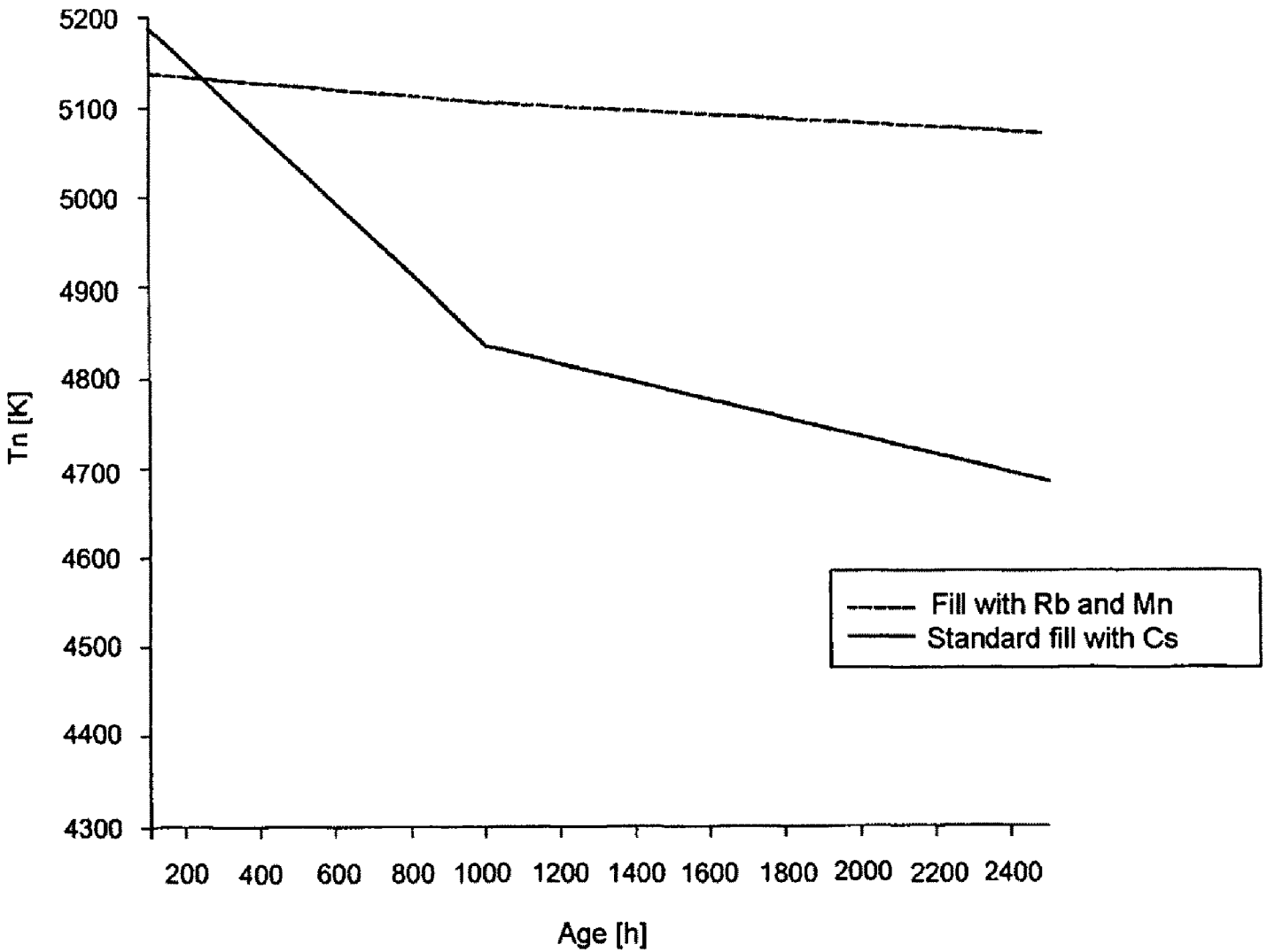
FIGS. 6 to 7 show the color temperature and the color locus as a function of the life of the two lamps from FIGS. 2 and 3.
Figure 7:
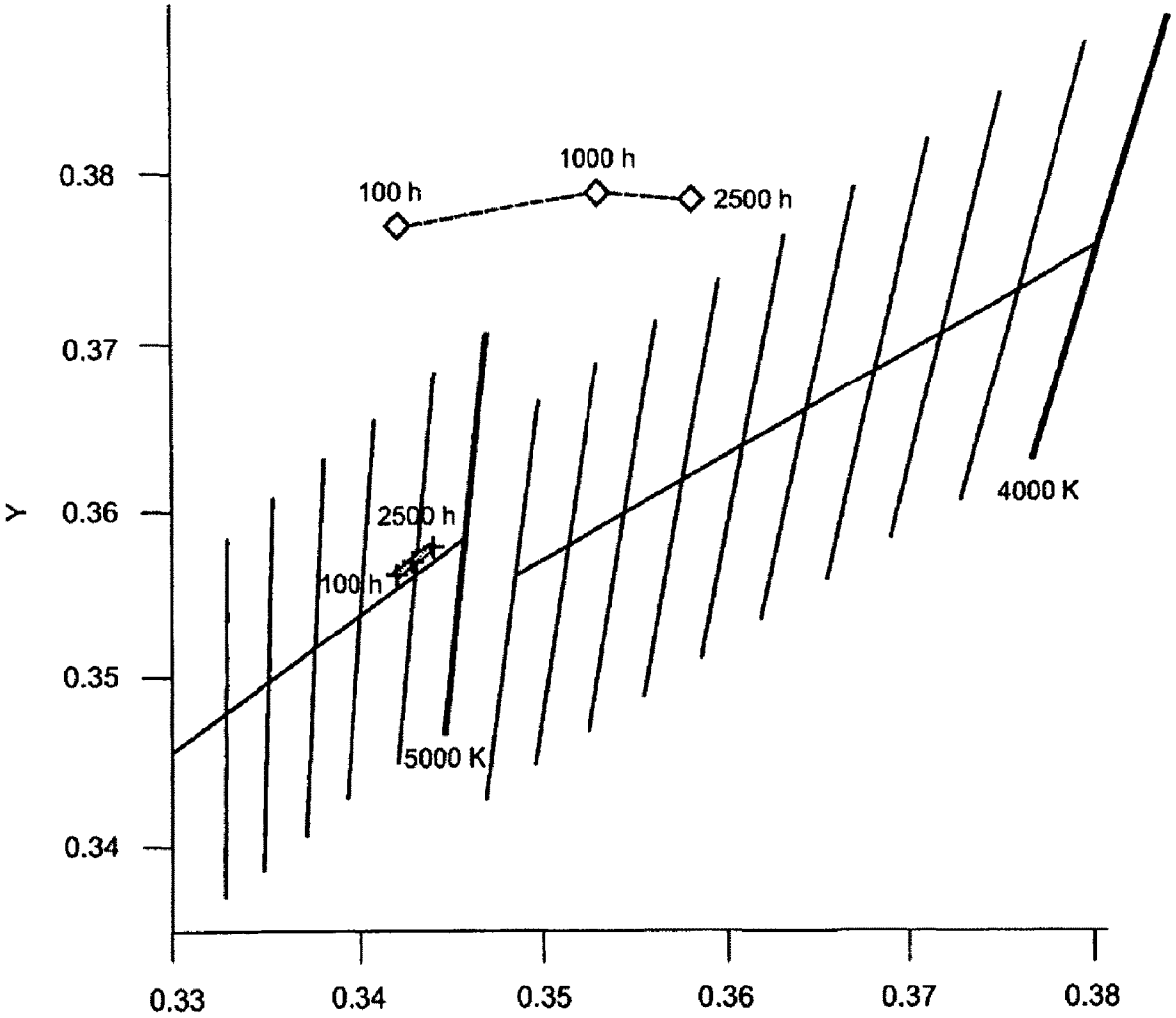

A further preference of the lamp with metal halide fill with Rb and Mn is its surprisingly high color stability. The most similar color temperature drifts in the time period of 100 h to 2500 h around only 70 K (cross). The color locus shifts parallel to the daylight curve. However, in the case of the lamp with a standard fill and Cs, the most similar color temperature drifts around approximately 500 K and the color locus does not move parallel to the daylight curve (diamonds) in the region of Judd's isotherms. This response is illustrated in FIGS. 6 and 7, which contain the most similar color temperature as a function of the lamp age (FIG. 6) and the color locus chart (FIG. 7).

The invention claimed is:

1. A high-pressure discharge lamp for general lighting or for photo-optical purposes, with a discharge vessel and two electrodes and with an ionizable fill comprising metal halides; Argon under a pressure of 56 mbar; mercury; and at least one halogen; said metal halide comprising rubidium halide and is free of cesium; manganese halide, thallium halide and at least one rare earth halide, selected from the group consisting of Dy, Ho, Tm alone or in combination, and wherein said fill provides for a color temperature of at least 4200 K.

2. The high-pressure discharge lamp as claimed in claim 1, wherein the proportion of further metal out of the group Tl, Dy, Ho, Tm, V is at least 0.1 μmol per ml of volume of the discharge vessel.

3. The high-pressure discharge lamp as claimed in claim 2, wherein the fill quantity of V is up to 25 μmol per ml of volume of the discharge vessel.

4. The high-pressure discharge lamp as claimed in claim 2, wherein the fill quantity of Dy is up to 35 μmol per ml of volume of the discharge vessel.

5. The high-pressure discharge lamp as claimed in claim 2, wherein the fill quantity of Tl is up to 15 μmol per ml of volume of the discharge vessel.

6. The high-pressure discharge lamp as claimed in claim 2, wherein the fill quantity of Ho is up to 18 μmol per ml of volume of the discharge vessel.

7. The high-pressure discharge lamp as claimed in claim 2, wherein the fill quantity of Tm is up to 18 μmol per ml of volume of the discharge vessel.

8. The high-pressure discharge lamp as claimed in claim 1, wherein the halogen is iodine and/or bromine.

9. The high-pressure discharge lamp as claimed in claim 1, wherein the fill additionally contains at least one further halide of V.

10. The high-pressure discharge lamp as claimed in claim 1, wherein the fill contains Rb in a quantity of from 0.01 to 60 μmol per ml of volume of the discharge vessel.

11. The high-pressure discharge lamp as claimed in claim 10, wherein the fill quantity of Mn is 0.01 to 50 μmol per ml of volume of the discharge vessel.

12. The high-pressure discharge lamp as claimed in claim 10, wherein the ratio of the masses of Rb:Mn is between 0.15 and 210.

13. The high-pressure discharge lamp as claimed in claim 10, wherein the discharge vessel (2) is arranged within an outer bulb (3).

* * * * *